United States Patent [19]

Meyerhoefer et al.

[11] Patent Number: 4,920,637

[45] Date of Patent: May 1, 1990

[54] WIRE INSERTION AND REMOVAL TOOL WITH MODULE REMOVAL MEANS

[75] Inventors: Carl Meyerhoefer, Dix Hills; Peter Visconti, Baldwin, both of N.Y.

[73] Assignee: Porta Systems Corp., Syosset, N.Y.

[21] Appl. No.: 413,690

[22] Filed: Sep. 28, 1989

[51] Int. Cl.[5] ..... H01R 43/00

[52] U.S. Cl. ..... 29/764; 7/107

[58] Field of Search ..... 7/107; 29/764, 566.4, 29/566.3, 750, 751, 758, 762

[56] References Cited

U.S. PATENT DOCUMENTS

| | | | |
|---|---|---|---|
| 3,628,202 | 12/1971 | Brown . | |
| 4,194,805 | 3/1980 | Ayer et al. | 29/764 |
| 4,425,704 | 1/1984 | Cline | 29/764 |
| 4,434,542 | 5/1984 | Forberg et al. | 29/566.4 |
| 4,567,639 | 2/1986 | Fasano | 29/566.4 |
| 4,852,925 | 8/1989 | Lodin | 29/764 |

*Primary Examiner*—Roscoe V. Parker

*Attorney, Agent, or Firm*—Charles E. Temko

[57] ABSTRACT

A hand-held tool for the convenient attachment and disconnection of conductors to individual insulation displacement terminals on a telephone connector block. The device includes a first member for serially inserting the free end of a conductor into a resiliently expandable slot in the terminal, and severing the end of the wire which projects from the slot at a predetermined length. A second remotely positioned member provides for the engagement of the conductor for removal of an unwanted connection. The last-mentioned member also includes structure for the engagement of a protector module overlying the terminal for purposes of removal of the same to gain access to the conductor.

2 Claims, 1 Drawing Sheet

FIG. 1.
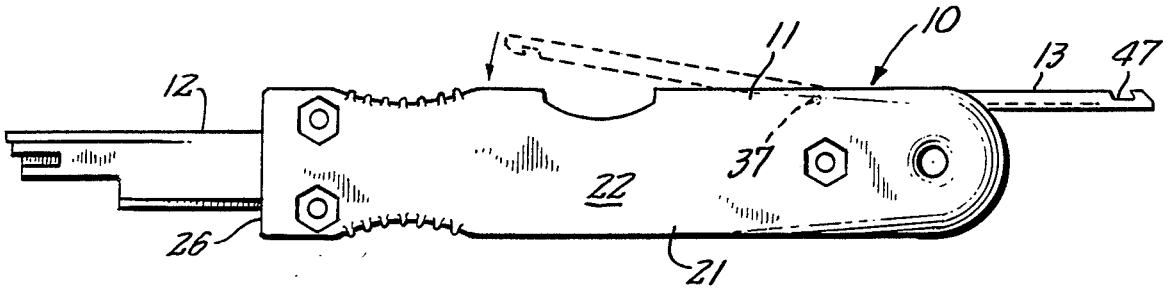
FIG. 2.
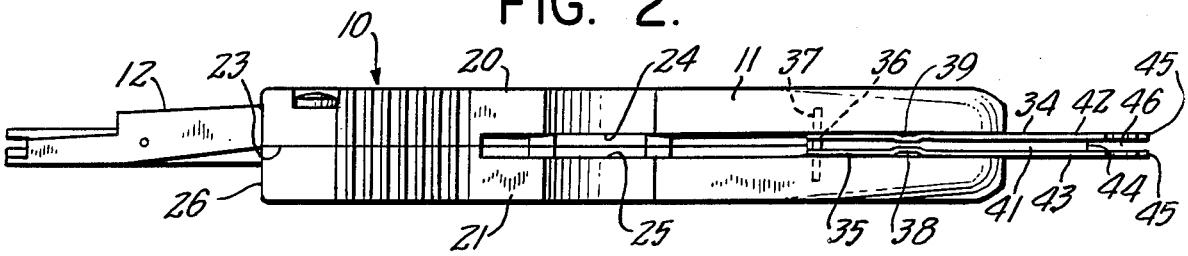
FIG. 3.
FIG. 4.
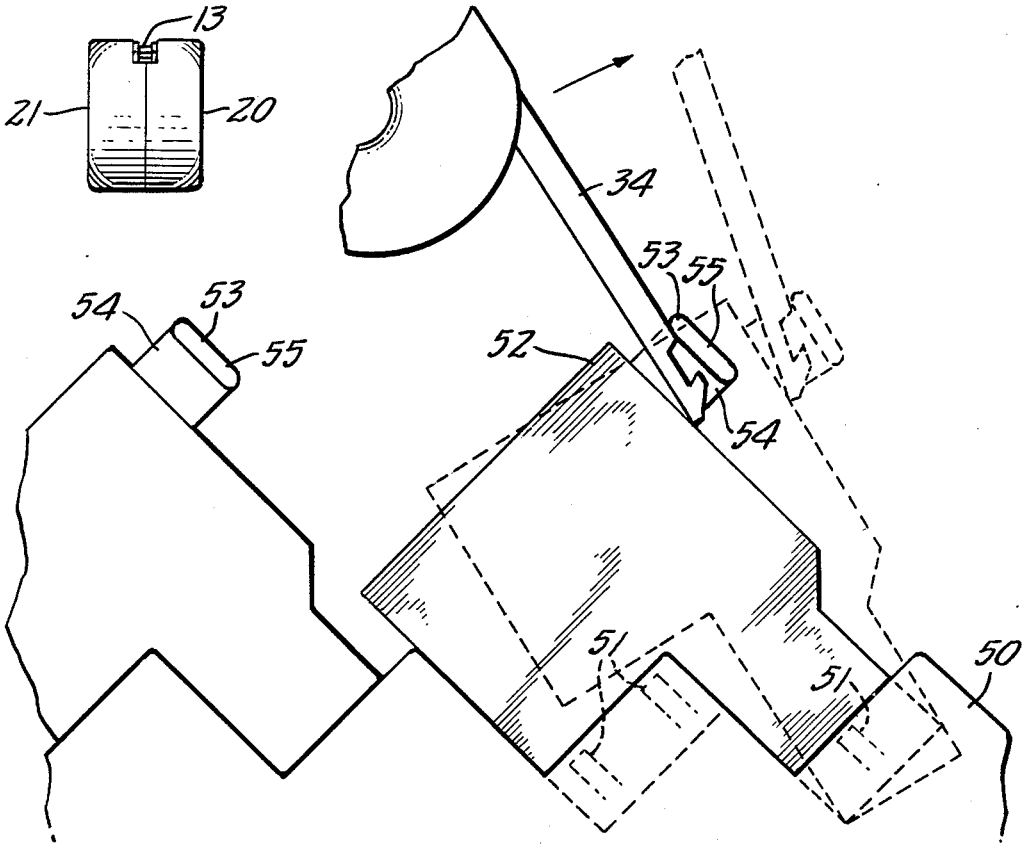

WIRE INSERTION AND REMOVAL TOOL WITH MODULE REMOVAL MEANS

BACKGROUND OF THE INVENTION

This invention relates generally to the field of telephony, and more particularly to an improved tool for inserting the free ends of wire conducts into resilient insulation displacement type terminals normally mounted upon connector blocks supported in turn, upon telephone main office frames.

The use of insulation displacement terminals has increased dramatically over the last decade because of considerations of cost and ease of interconnection. Connectors of this type normally consist of a flat metallic stamping having a plurality of resiliently expandable open-ended slots on one end thereof, the opposite end being imbedded in the block for connection thereto by wire wrap or other operation which may be made at the time of manufacture of the block. The slots are so configured that upon insertion of an insulated conductor, the insulation is cut and removed from the conductor only in the area of contact with the terminal, thus avoiding the necessity of a separate wire stripping operation. It is known in the art to provide a tool for this purpose, including means to trim the exposed stub to a predetermined length, so that it will not interfere with other adjacently located conductors. The tool usually provides means on one end thereof for engaging a seated conductor to disconnect it from a terminal by pulling upon the body of the conductor itself.

In recent years, improved connector blocks have been manufactured which comprise a plurality of laminar type elements in juxtaposed relation, each lamina mounting a plurality of insulation displacement terminals projecting laterally therefrom. Corresponding protector modules have been produced, the effective thickness of which corresponds to that of an individual lamina, which protector modules are directly engaged upon the insulation displacement terminals, so that individual subscriber circuit protection is afforded without the necessity of providing a separate protector block. The protector blocks in mounted condition, are juxtaposed with respect to other modules, so that removal of an individual module to gain access to the terminals disposed therebeneath cannot be readily accomplished without the use of a tool.

SUMMARY OF THE INVENTION

Briefly stated, the invention contemplates the provision of an improved wire installation tool of the type referred to, in which provision has been made not only for the forcing of the end of a conductor into a slot in the insulation displacement terminal as well as provision at an opposite end of the tool for the engagement of a projecting stub to provide convenient disengagement and removal of an unwanted conductor, as is known in the art. In addition, the same opposite end is provided with means for engaging a projection on an associated protector module for conventient removal thereof without disturbing adjacent engaged modules to provide access to the associated terminals disposed beneath the removed module.

BRIEF DESCRIPTION OF THE DRAWING

In the drawing, to which reference will be made in the specification, similar reference characters have been employed to designate corresponding parts throughout the several views.

FIG. 1 is a side elevational view of a tool embodying the invention.

FIG. 2 is a top plan view thereof.

FIG. 3 is an end elevational view thereof as seen from the right-hand portion of FIG. 1.

FIG. 4 is a view in perspective of a laminar type connector block element and associated protector module, showing the disengagement of the module from the block using the tool of FIGS. 1 to 3.

DETAILED DESCRIPTION OF THE DISCLOSED EMBODIMENT

In accordance with the invention, the device, generally indicated by reference character 10, comprises broadly, a housing or handle element 11, a conductor insertion element 12, and a conductor removal element 13.

The handle element 11 may be of molded synthetic resinous construction, and includes first and second elongate members 20 and 21, each being bounded by an outer rounded surface 22 and an inner planar surface 23, which surface forms a first tool retaining channel 24 and a second tool retaining channel 25. The element 11 is bounded at one end by a planar end surface 26.

The conductor insertion element 12 is substantially similar to that disclosed in U.S. Pat. No. 4,567,639, assigned to the same assignee as the present application, the teachings of which are incorporated by reference. Accordingly, the details of the same need not be further considered herein. This element serves to insert the free ends of one or more conductors into corresponding insulation displacement terminals and sever a projecting excess length at the same time.

The conductor removal element 13 resembles, to some degree, that disclosed in the above-mentioned patent, but in addition to providing hook-like means for the removal of an unwanted conductor, it provides additional means for the removal of a protector module associated with the insulation displacement terminals on a connector block.

In recent years there has been increased use of so-called laminar type connector blocks which are formed to include a plurality of laminar elements held in juxtaposed relation by threaded connectors. Each laminar element is provided with insulation displacement terminals projecting laterally therefrom, this type of block providing very high subscriber circuit density to a degree not normally obtainable using other types of blocks. To eliminate the need for providing separate protector block or protector module field, it is possible to use miniaturized protector modules which are directly engaged upon the projecting insulation displacement terminals. Reference is made to the copending application of Carl H. Meyerhoefer and Helmuth Neuwirth, Ser. No. 07/306,084 field, 2-6-89; said application having been assigned to the same assignee as the prsent application. This application, and any patent maturing therefrom, are also incorporated by reference.

Accordingly, the removal element 13 comprises a pivotally mounted blade member 34 having an inner end 35 enclosing a transversely extending bore 36 engaged by a pin 37. Detent means 38 on the handle element corresponds with corresponding detent means 39 on the blade member to selectively lock the blade member in extended position. As best seen in FIGS. 2 and 3, the member 34 may be in the form of a metallic stamping formed of U-shaped cross section wherein it includes a base wall 41 interconnecting a pair of parallel side walls 42 and 43. The outer end 44 of the base wall 41 is longitudinally displaced from the outer ends 45 of the side walls, thereby forming an elongated slot 46. The side walls include known hook-like notches 47 for engaging a conductor and disengaging it from an insulation displacement terminal.

Referring to FIG. 4, there is illustrated a single laminar element 50 forming part of a composite laminar type connector block (not shown) as disclosed in the above-mentioned patent application. The element 50 supports plural contacts 51 which extend laterally from the principal axis thereof, the contacts being directly engaged by protector modules 52 of width corresponding to that of the element 50. To enable removal of the modules to uncover the insulation displacement contacts, there is provided a handle member 53 supported upon the outer surface of each module, the member 53 including a relatively thin shank 54 and an enlarged terminal 55 thereon.

When it is desired to disconnect a conductor from an insulation displacement contact which is engaged by a protector module, it is necessary to first disengage the module. Owing to the close proximity of each module to adjacent modules positioned on adjacent laminar elements, this can not normally be readily accomplished using the fingers of service personnel. Using the disclosed device, the blade member 34 is first engaged with the shank 54 and terminal 55, preferably facing the notches 47 in an opposite direction, and using the handle element 11 as a lever, the module can be disengaged to a degree sufficient to permit subsequent manual grasping of the same for complete removal. With the removal of the module, the insulation displacement contact is exposed for access, and unwanted conductors can be disengaged therefrom using the hook-like notches 47 in a manner well-known in the art.

It may thus be seen that I have invented novel and highly useful improvements in installation tools for use in seating and disengaging terminals on a telephone connector block. The disclosed embodiment is capable of performing all of the functions provided by prior art devices, and in addition, the device may be used to disenage protector modules which are engaged upon the insulation displacement terminals in such manner that they are not readily accessible for mere manual removal.

I wish it to be understood that I do not consider the invention limited to the precise details of structure shown and set forth in this specification, for obvious modifications will occur to those skilled in the art to which the invention pertains.

I claim:

1. In a tool for removing an engaged wire conductor from a slot in an insulation displacement terminal, the tool including a manually engageable handle element and a wire removal element having a free end projecting from said handle element, said wire removal element having hook-like means for engaging said conductor, the improvement comprising: said wire removal element being of generally U-shaped cross section and forming a base wall and a pair of parallel side walls extending to a free end thereof, said hook-like means being located in at least one of said side walls; said base wall being longitudinally shorter than said side walls to form an elongated slot between said side walls; whereby said side walls are adapted to engage an enlargement on a protector module overlying said insulation displacement terminal to facilitate removal therefrom to gain access to said insulation displacement terminal.

2. In a combination of telephone connector block having projecting insulation displacement terminals extending therefrom, a protector module resiliently engaging said insulation displacement terminals to effect electrical communication therebetween, and a tool for installing and removing conductors in engagement with said insulation displacement terminals, said protector module having an outer surface mounting an engageable handle including an enlargement on an end thereof, the improvement comprising: said tool having a wire removal element on one end thereof of generally U-shaped cross section to include a base wall and a pair of parallel side walls, wire-engaging hook like means formed in at least one side wall adjacent a free end thereof, said base wall being shorter in longitudinal length than that of said side walls to form an elongated slot between said side walls of width less than the width of said enlargement on said handle; whereby said enlargement may be selectively slidably engaged within said slot to facilitate removal of said protector module from engagement with corresponding insulation displacement terminals to enable access to said insulation displacement terminals.

* * * * *